US006991231B1

(12) United States Patent
Tien

(10) Patent No.: US 6,991,231 B1
(45) Date of Patent: Jan. 31, 2006

(54) PLAYING TABLE HAVING A LIGHT EMITTING EFFECT

(75) Inventor: Feng-Yi Tien, Jia Yi (TW)

(73) Assignee: Acas Design Co., Ltd., Jia Yi (TW)

( * ) Notice: Subject to any disclaimer, the term of this patent is extended or adjusted under 35 U.S.C. 154(b) by 20 days.

(21) Appl. No.: 10/888,639

(22) Filed: Jul. 9, 2004

(51) Int. Cl.
*A63F 7/05* (2006.01)

(52) U.S. Cl. ..... 273/108.1; 273/108.2; 273/309

(58) Field of Classification Search ..... 273/237, 273/108, 108.1; 463/36, 12; 108/23
See application file for complete search history.

(56) References Cited

U.S. PATENT DOCUMENTS

| | | | | |
|---|---|---|---|---|
| 3,802,708 | A * | 4/1974 | Libert | 273/237 |
| D240,246 | S * | 6/1976 | Perrie | D21/318 |
| 3,979,156 | A * | 9/1976 | Gross | 312/196 |
| 4,450,774 | A * | 5/1984 | Weaver | 108/23 |
| 5,695,270 | A * | 12/1997 | Collet | 362/34 |
| 5,791,758 | A * | 8/1998 | Horgan et al. | 362/554 |
| 5,876,262 | A * | 3/1999 | Kelly et al. | 446/118 |
| 5,911,496 | A * | 6/1999 | Hojnacki | 362/131 |
| 6,105,961 | A * | 8/2000 | Price | 273/108.52 |
| 6,293,864 | B1 * | 9/2001 | Romero | 463/12 |
| D449,185 | S * | 10/2001 | Solloway | D6/480 |
| 6,619,662 | B2 * | 9/2003 | Miller | 273/274 |
| D499,149 | S * | 11/2004 | Doherty et al. | D21/318 |
| 6,854,728 | B2 * | 2/2005 | Oister et al. | 273/108.1 |
| 2002/0125633 | A1 * | 9/2002 | Mashkabov | 273/108.1 |
| 2003/0197326 | A1 * | 10/2003 | Makhoul | 273/108.54 |
| 2004/0067796 | A1 * | 4/2004 | Murrey et al. | 473/4 |
| 2004/0124582 | A1 * | 7/2004 | Oister et al. | 273/108 |
| 2004/0164488 | A1 * | 8/2004 | Fitzgerald | 273/108.1 |
| 2004/0195762 | A1 * | 10/2004 | Oister et al. | 273/108.1 |
| 2005/0006841 | A1 * | 1/2005 | Schromm | 273/108.4 |
| 2005/0035541 | A1 * | 2/2005 | Oister et al. | 273/108.1 |
| 2005/0064936 | A1 * | 3/2005 | Pryor | 463/36 |
| 2005/0127601 | A1 * | 6/2005 | Giegerich et al. | 273/108.1 |

* cited by examiner

*Primary Examiner*—Vishu Mendiratta
*Assistant Examiner*—Dolores Collins
(74) *Attorney, Agent, or Firm*—Alan D. Kamrath; Nikolai & Mersereau, P.A.

(57) ABSTRACT

A playing table includes a transparent base plate, four foot stands mounted on the corners of the base plate and each having an upper end having a side formed with a through hole, and four light emitting members each mounted in a respective one of the foot stands and each aligning with the through hole. Thus, each of the light emitting members emits a light source passed through the through hole of a respective one of the foot stands and projected onto the base plate, so that the playing table has a light emitting effect, thereby enhancing the aesthetic quality of the playing table.

14 Claims, 5 Drawing Sheets

PLAYING TABLE HAVING A LIGHT EMITTING EFFECT

BACKGROUND OF THE INVENTION

1. Field of the Invention

The present invention relates to a playing table, and more particularly to a playing table having a light emitting effect.

2. Description of the Related Art

A conventional playing table comprises a base plate, four side plates mounted on the periphery of the base plate, a cover plate mounted on the side plates, two opposite score counters mounted on the cover plate, and four foot stands mounted on the corners of the base plate. However, the conventional playing table does not have a light emitting effect, thereby decreasing the aesthetic quality of the playing table.

SUMMARY OF THE INVENTION

The primary objective of the present invention is to provide a playing table having a light emitting effect, thereby enhancing the aesthetic quality of the playing table.

In accordance with the present invention, there is provided a playing table, comprising:

a transparent base plate having four corners;

four foot stands each mounted on a respective one of the four corners of the base plate and each having an upper end having a side formed with a through hole; and four light emitting members each mounted in a respective one of the four foot stands and each aligning with the respective through hole.

Further benefits and advantages of the present invention will become apparent after a careful reading of the detailed description with appropriate reference to the accompanying drawings.

DETAILED DESCRIPTION OF THE INVENTION

Figure 1:
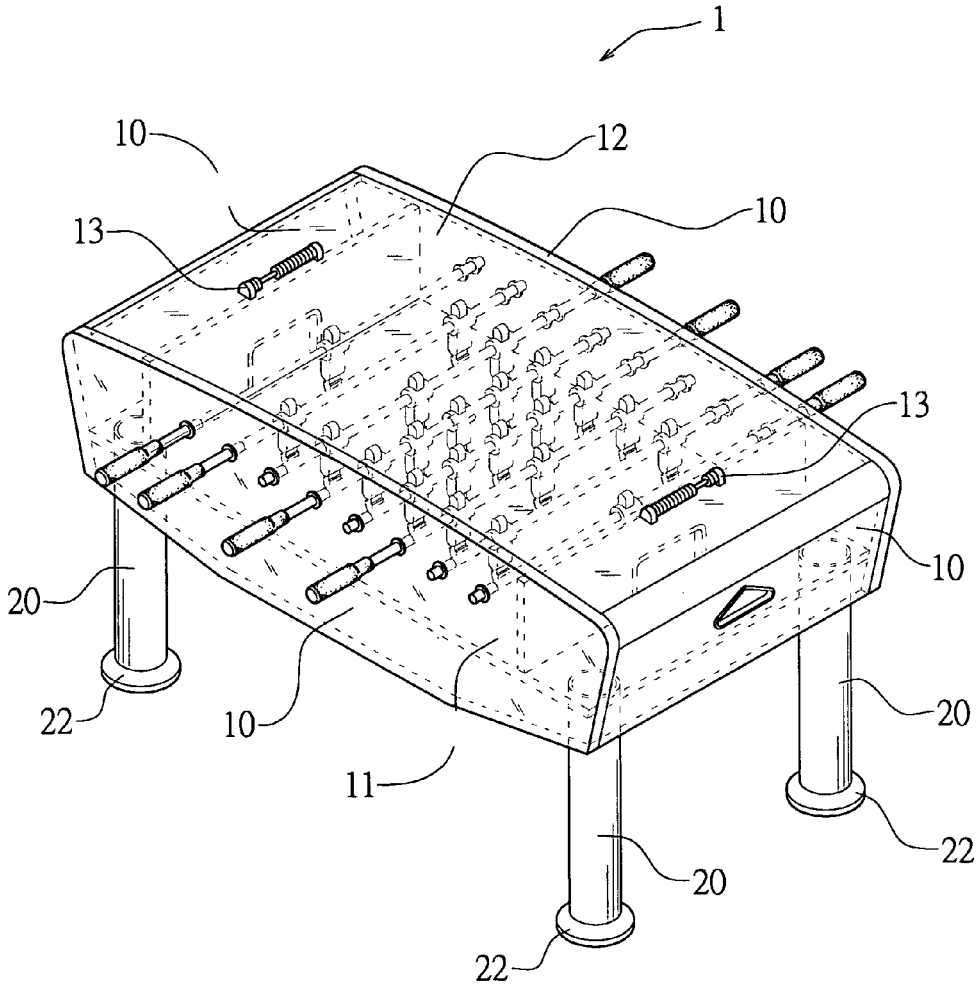
FIG. 1 is a perspective view of a playing table in accordance with the preferred embodiment of the present invention.
Figure 2:
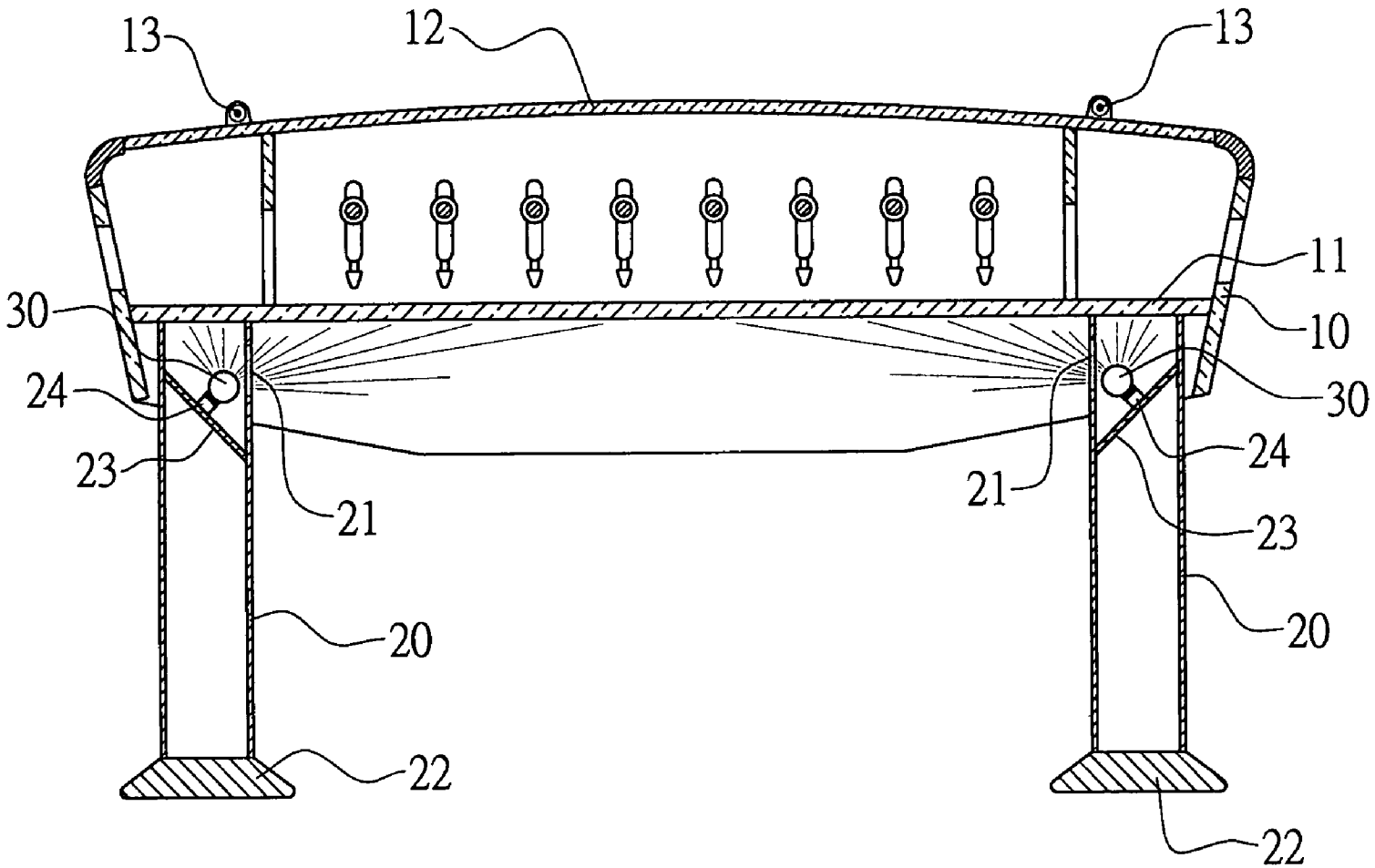
FIG. 2 is a plan cross-sectional view of the playing table as shown in FIG. 1.
Figure 3:
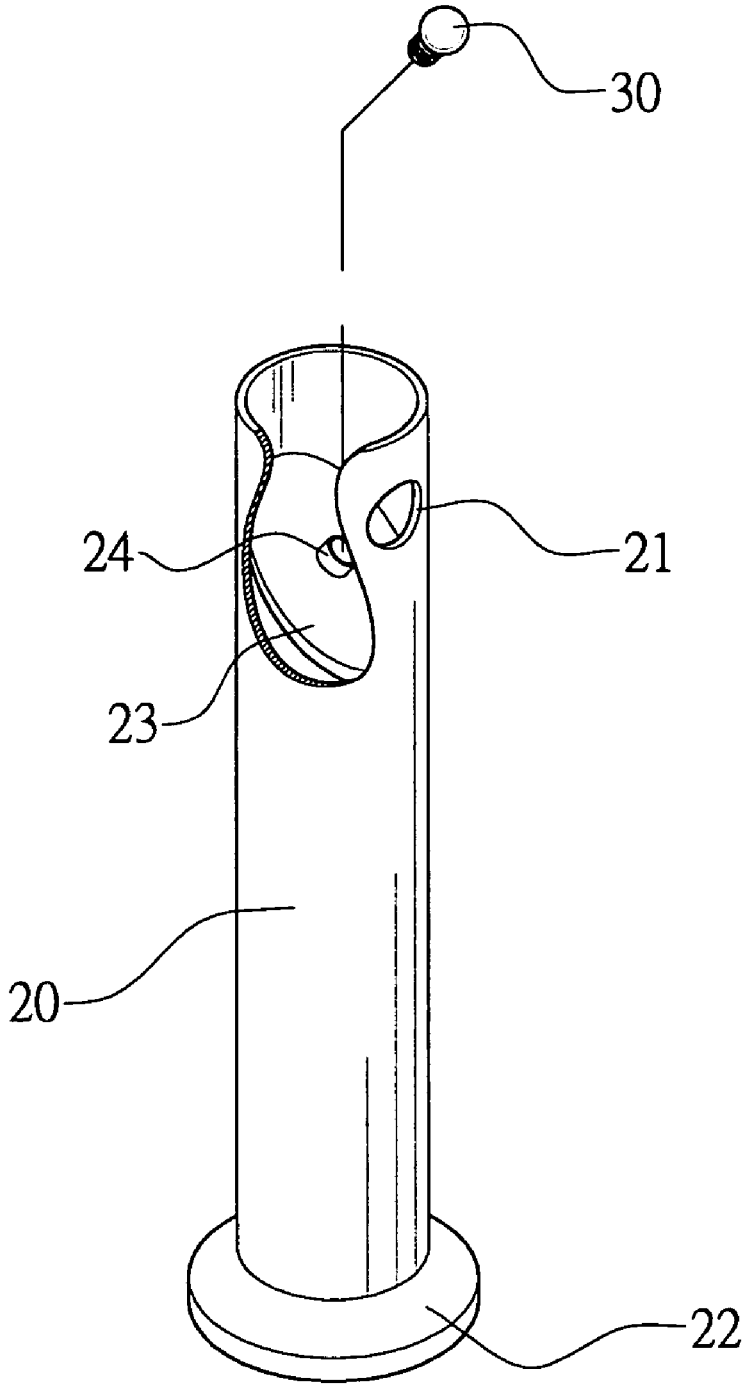
FIG. 3 is a partially perspective cross-sectional view of a foot stand of the playing table as shown in FIG. 1.

Referring to the drawings and initially to FIGS. 1–3, a playing table in accordance with the preferred embodiment of the present invention comprises a transparent base plate 11 having four corners, four transparent side plates 10 mounted on a periphery of the base plate 11, a transparent cover plate 12 mounted on the four side plates 10, two score counters 13 mounted on the cover plate 12, four foot stands 20 each mounted on a respective one of the four corners of the base plate 11 and each having an upper end having a side formed with a through hole 21 and a lower end formed with a support seat 22, and four light emitting members 30 each mounted in a respective one of the four foot stands 20 and each aligning with the respective through hole 21.

The playing table further comprises four fixing plates 23 each mounted in the upper end of a respective one of the four foot stands 20, and four lamp seats 24 each mounted on a respective one of the four fixing plates 23, and each of the four light emitting members 30 is mounted on a respective one of the four lamp seats 24. Preferably, each of the four light emitting members 30 is bulb.

Preferably, each of the four fixing plates 23 is arranged in an oblique manner and is directed toward the through hole 21 of a respective one of the four foot stands 20 and toward the base plate 11 as shown in FIG. 2.

In practice, when each of the light emitting members 30 emits a light source outward, each of the fixing plates 23 is directed toward the through hole 21 of a respective one of the foot stands 20 and the base plate 11, so that the light source of each of the light emitting members 30 passes through the through hole 21 of a respective one of the foot stands 20 and is projected onto the base plate 11 as shown in FIG. 2. In such a manner, the base plate 11, the side plates 10 and the cover plate 12 are transparent to permeate the light source from the light emitting members 30, thereby enhancing the aesthetic quality of the playing table 1.

Figure 4:
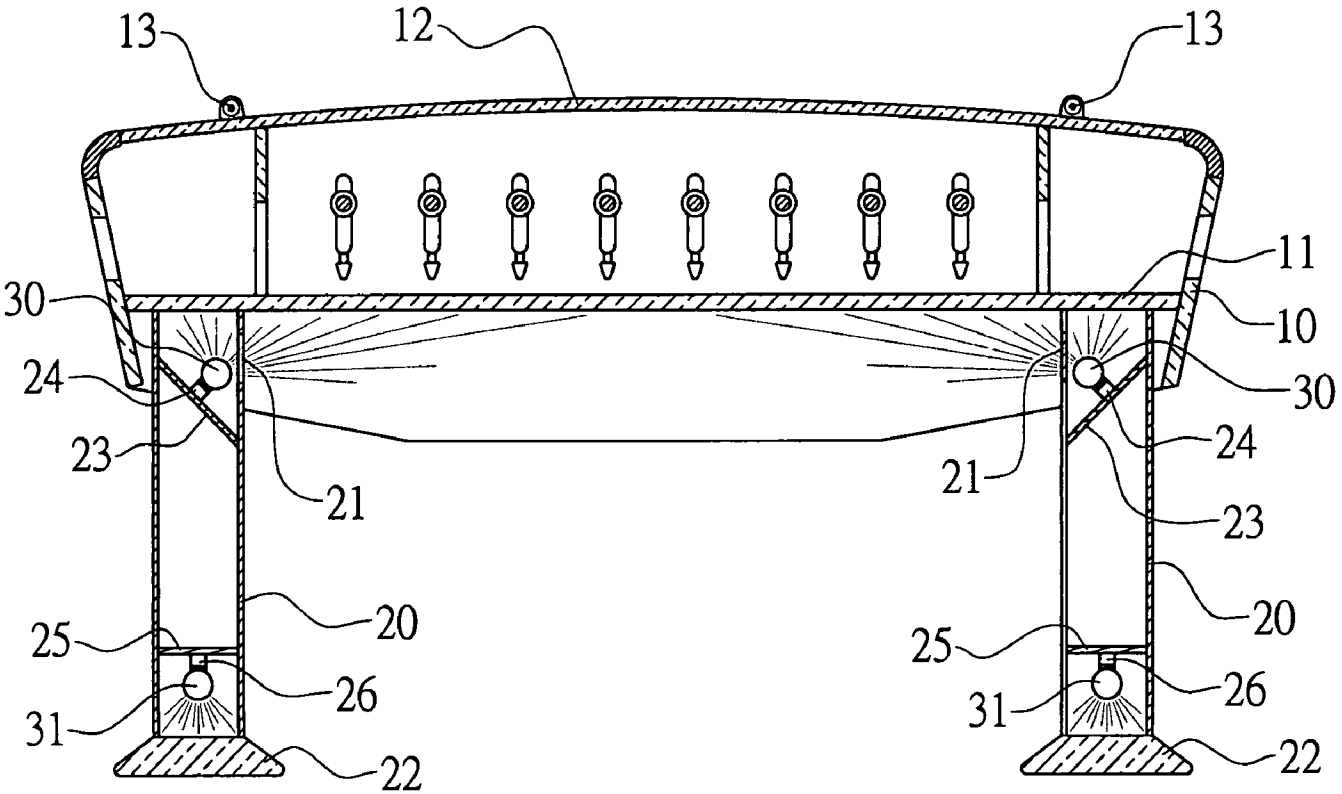
FIG. 4 is a plan cross-sectional view of a playing table in accordance with another embodiment of the present invention.
Figure 5:
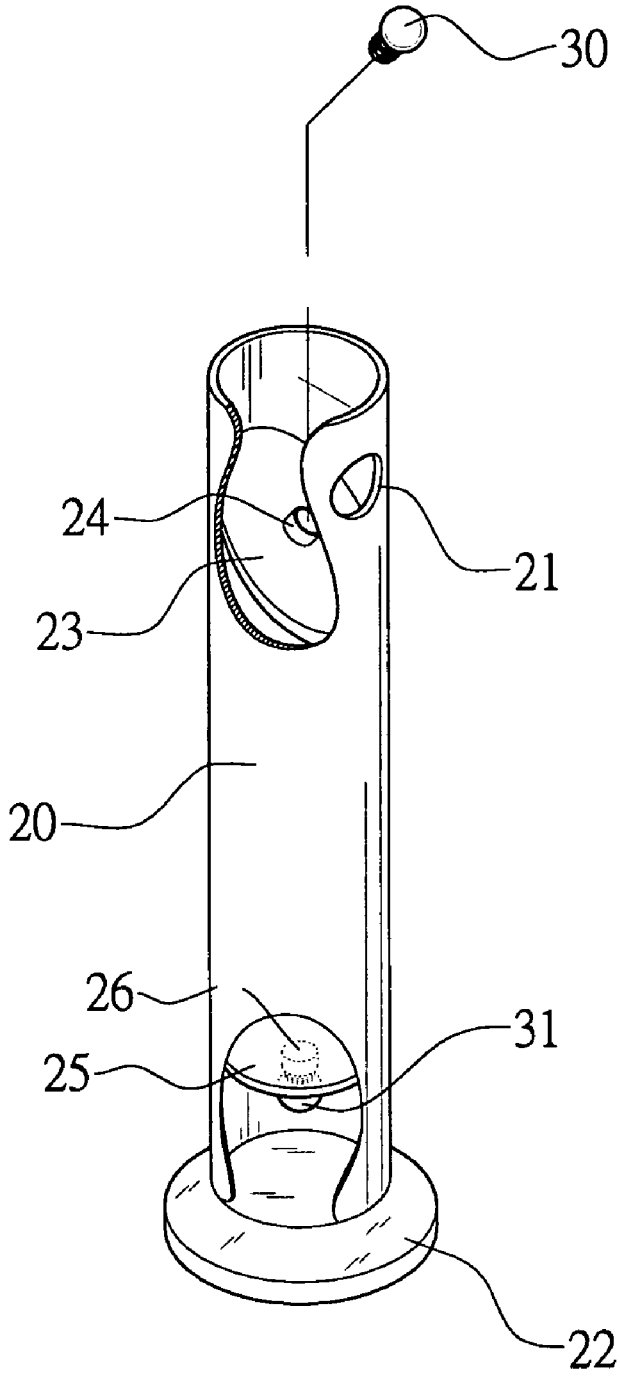
FIG. 5 is a partially perspective cross-sectional view of a foot stand of the playing table as shown in FIG. 4.

Referring to FIGS. 4 and 5, the support seat 22 of each of the foot stands 20 is made transparent, and the playing table further comprises four secondary fixing plates 25 each mounted in the lower end of a respective one of the foot stands 20, four secondary lamp seats 26 each mounted on a respective one of the secondary fixing plates 25, and four secondary light emitting members 31 mounted on a respective one of the secondary lamp seats 26. Preferably, each of the secondary light emitting members 31 is bulb. Preferably, each of the secondary fixing plates 25 is arranged in a horizontal manner and is directed toward the support seat 22 of a respective one of the foot stands 20 as shown in FIG. 4.

In practice, when each of the secondary light emitting members 31 emits a light source outward, each of the secondary fixing plates 25 is directed toward the support seat 22 of a respective one of the foot stands 20, so that the light source of each of the secondary light emitting members 31 is projected onto the support seat 22 of a respective one of the foot stands 20 as shown in FIG. 4. In such a manner, the support seat 22 of each of the foot stands 20 is transparent to permeate the light source from the secondary light emitting members 31, thereby enhancing the aesthetic quality of the playing table.

Although the invention has been explained in relation to its preferred embodiment(s) as mentioned above, it is to be understood that many other possible modifications and variations can be made without departing from the scope of the present invention. It is, therefore, contemplated that the appended claim or claims will cover such modifications and variations that fall within the true scope of the invention.

What is claimed is:

1. A playing table, comprising:

a transparent base plate having four corners;

four foot stands each mounted on a respective one of the four corners of the base plate and each having an upper end having a side formed with a through hole; and four light emitting members each mounted in a respective one of the four foot stands and each aligning with the respective through hole.

2. The playing table in accordance with claim 1, further comprising four transparent side plates mounted on a periphery of the base plate.

3. The playing table in accordance with claim 2, further comprising a transparent cover plate mounted on the four side plates.

4. The playing table in accordance with claim 1, wherein each of the four light emitting members is bulb.

5. The playing table in accordance with claim 1, further comprising four fixing plates each mounted in the upper end of a respective one of the four foot stands, and four lamp seats each mounted on a respective one of the four fixing plates, wherein each of the four light emitting members is mounted on a respective one of the four lamp seats.

6. The playing table in accordance with claim 5, wherein each of the four fixing plates is arranged in an oblique manner.

7. The playing table in accordance with claim 5, wherein each of the four fixing plates is directed toward the through hole of a respective one of the four foot stands.

8. The playing table in accordance with claim 5, wherein each of the four fixing plates is directed toward the base plate.

9. The playing table in accordance with claim 1, wherein each of the light emitting members emits a light source passed through the through hole of a respective one of the foot stands and projected onto the base plate.

10. The playing table in accordance with claim 1, wherein each of the four foot stands has a lower end formed with a transparent support seat, and the playing table further comprises four secondary fixing plates each mounted in the lower end of a respective one of the foot stands, four secondary lamp seats each mounted on a respective one of the secondary fixing plates, and four secondary light emitting members mounted on a respective one of the secondary lamp seats.

11. The playing table in accordance with claim 10, wherein each of the secondary light emitting members is bulb.

12. The playing table in accordance with claim 10, wherein each of the secondary fixing plates is arranged in a horizontal manner.

13. The playing table in accordance with claim 10, wherein each of the secondary fixing plates is directed toward the support seat of a respective one of the foot stands.

14. The playing table in accordance with claim 10, wherein each of the secondary light emitting members emits a light source projected onto the support seat of a respective one of the foot stands.

* * * * *